US007614156B1

(12) United States Patent
Imig

(10) Patent No.: US 7,614,156 B1
(45) Date of Patent: Nov. 10, 2009

(54) BOW-MOUNTED SIGHT WITH RANGE FINDER AND DATA STORAGE MEANS

(76) Inventor: Chris D. Imig, W9825 Branch Rd., Deerbrook, WI (US) 54424

( * ) Notice: Subject to any disclaimer, the term of this patent is extended or adjusted under 35 U.S.C. 154(b) by 0 days.

(21) Appl. No.: 12/287,000

(22) Filed: Oct. 3, 2008

Related U.S. Application Data

(60) Provisional application No. 60/997,480, filed on Oct. 4, 2007.

(51) Int. Cl.
*F41G 1/32* (2006.01)
*F41G 1/467* (2006.01)

(52) U.S. Cl. ..... 33/265; 124/87

(58) Field of Classification Search ..... 33/265; 124/86–88
See application file for complete search history.

(56) References Cited

U.S. PATENT DOCUMENTS 4,290,219 A * 9/1981 Boller et al. ..... 42/106
4,296,725 A * 10/1981 Broderick ..... 124/88
4,617,741 A * 10/1986 Bordeaux et al. ..... 33/265
4,753,528 A * 6/1988 Hines et al. ..... 33/265
5,479,712 A * 1/1996 Hargrove et al. ..... 33/265
6,154,971 A * 12/2000 Perkins ..... 33/265
6,191,574 B1 * 2/2001 Dilger ..... 124/87
6,397,483 B1 * 6/2002 Perkins ..... 33/265
6,526,956 B1 * 3/2003 Hankins ..... 124/86
6,952,881 B2 * 10/2005 McGivern ..... 33/265
7,162,806 B1 * 1/2007 Swiggart ..... 33/265
7,296,358 B1 * 11/2007 Murphy et al. ..... 33/265
7,313,871 B2 * 1/2008 Lines et al. ..... 33/365
7,513,050 B2 * 4/2009 Kroening, Jr. ..... 33/265
2007/0068018 A1 * 3/2007 Gilmore ..... 33/265
2008/0107414 A1 * 5/2008 Showalter ..... 396/429

* cited by examiner

*Primary Examiner*—Yaritza Guadalupe-McCall
(74) *Attorney, Agent, or Firm*—Tipton L. Randall

(57) ABSTRACT

A bow-mounted sight unit, containing a range finder with data storage, includes an optical sight unit for viewing a target. The sight unit has a housing which supports a viewing screen. A cross-hairs member has vertical and horizontal sighting cross-hair portions and is superimposed on the viewing screen. A laser range finder member calculates the range distance to the intended target. A control member allows entering and accessing data retained by a microprocessor member and connected data storage member of the unit. Data is displayed on the viewing screen adjacent to the field of view. In operation, the microprocessor member calculates an arrow drop compensation distance automatically, using the historical arrow-drop data in conjunction with the range distance. The compensation distance is displayed in the field of view by automatic adjustment of the cross-hairs member by the microprocessor member.

18 Claims, 4 Drawing Sheets

BOW-MOUNTED SIGHT WITH RANGE FINDER AND DATA STORAGE MEANS

CROSS-REFERENCE TO RELATED APPLICATIONS, IF ANY

This application claims the benefit under 35 U.S.C. § 119 (e) of co-pending provisional application Ser. No. 60/997,480, filed 4 Oct. 2007. Application Ser. No. 60/997,480 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a bow-mounted sight unit and, more particularly, to a bow-mounted sight unit with range finder capability and, most particularly, to a bow-mounted sight unit with range finder capability and with data storage means.

2. Background Information

Hunters using a bow and arrow are continually confronted with changing conditions when hunting in the field. When firing an arrow from a bow, the hunter must take into account the distance to the target, the effect of cross wind, and even the weight and velocity of the arrow being fired. The hunter must often make estimates for these critical factors and adjust his/her aim accordingly. However, the hunter is often required to make the estimates quickly, and even the most experienced hunter cannot always hit the target, as desired.

To assist the hunter in hitting the target, bow-mounted sights have been developed for sighting on the target. Many bow-mounted sights usually include sighting pins, or similar devices, mounted on the bow for aiming the arrow at the target. The bow-mounted sight is provided a number of sighting pins, each of which is positioned to account for various distances to a target. The hunter can "sight in" the bow and arrow for a specific distance to the target by adjusting the pins of the sight and firing the arrow at a target to verify that the arrow hits the distant target with that particular sighting pin centered on the target. The arrows used by the hunter must be quite uniform in weight and design for consistency. Thus, the bow sight will contain a number of sighting pins for sighting a target at various distances. However, the hunter is still required to calculate and estimate the distance to the target, and this estimate is prone to mistakes that can cause him/her to miss the target. Consequently, there is an unmet need for a bow-mounted sight that can automatically make adjustments of the sight to take into account as many of the above-mentioned variables as possible.

Applicant has devised a bow-mounted sight unit, containing a range finder with data storage, or memory, that automatically makes adjustments to the bow-mounted sight unit so that the fired arrow hits the desired target.

SUMMARY OF THE INVENTION

The invention is directed to a bow-mounted sight unit, containing a range finder with data storage. The bow-mounted sight unit includes an optical sight unit for viewing a target area, the sight unit having a housing member supporting a viewing screen member and at least one optical lens member that comprises a field of view when viewed on the screen member. A cross-hairs member has a vertical sighting cross-hair portion, perpendicular to a horizontal sighting cross-hair portion, for identifying an intended target. The cross-hairs member spans the interior of the sighting unit and is superimposed on the viewing screen member. There is a vertical, cross-hair portion, adjustment member that allows for fine-tuning the positioning of the vertical sighting cross-hair portion. A laser range finder member is mounted in the housing member, and the range finder member calculates the range distance between the optical sight unit and the intended target. The sight unit also includes a microprocessor member mounted in the housing, with a data storage member operatively connected to the microprocessor member. A control member is present for manually entering and accessing data retained by the microprocessor member and the operatively connected data storage member. A display member is included within the viewing screen and displays data in an area adjacent to the field of view thereon. A power source is mounted within the housing member for energizing the viewing screen member, the range finder member, the microprocessor member and the data storage member. In operation, the microprocessor member calculates an arrow drop compensation distance automatically, using the historical arrow-drop data in conjunction with the range distance. The compensation distance is displayed in the field of view by automatic adjustment of the cross-hairs member by the microprocessor member.

In a preferred embodiment of the invention, the viewing screen is an LCD screen, and an ON/OFF switch member is present for activating or deactivating the bow-mounted sight unit. In addition, an attachment device is fastened to the housing member for mounting the housing member of the bow-mounted sight unit with a range finder to an archery bow.

DESCRIPTION OF THE EMBODIMENTS

Nomenclature

10 Bow-Mounted Sight Unit
15 Optical Sight Unit
20 Housing Member of Unit
25 Viewing Screen Member
27 Optical Lens Member
30 Cross-Hairs Member
35 Vertical Cross-Hair Portion
40 Horizontal Cross-Hair Portion
50 Vertical Cross-Hair Adjustment Member
60 Laser Range Finder Member

65 Microprocessor Member
70 Data Storage Member
74 Control Member
76 Memory Button Member
77 Set Button Member
78 Run Button Member
80 Display Member
85 Battery Member
90 Attachment Bracket Member
95 ON/OFF Switch Member
A Arrow
B Bow
C Target Construction The invention is a bow-mounted sight unit, containing a range finder with data storage. The bow-mounted sight unit includes an optical sight unit for viewing a target area, the sight unit having a housing member supporting a viewing screen member and at least one optical lens member that comprises a field of view when viewed on the screen member. A cross-hairs member has a vertical sighting cross-hair portion, perpendicular to a horizontal sighting cross-hair portion, for identifying an intended target. The cross-hairs member spans the interior of the sighting unit and is superimposed on the viewing screen member. There is a vertical, cross-hair portion, adjustment member that allows for fine-tuning the positioning of the vertical sighting cross-hair portion. A laser range finder member is mounted in the housing member, and the range finder member calculates the range distance between the optical sight unit and the intended target. The sight unit also includes a microprocessor member mounted in the housing, with a data storage member operatively connected to the microprocessor member. A control member is present for manually entering and accessing data retained by the microprocessor member and the operatively connected data storage member. A display member is included within the viewing screen and displays data in an area adjacent to the field of view thereon. A power source is mounted within the housing member for energizing the viewing screen member, the range finder member, the microprocessor member and the data storage member. In operation, the microprocessor member calculates an arrow drop compensation distance automatically, using the historical arrow-drop data in conjunction with the range distance. The compensation distance is displayed in the field of view by automatic adjustment of the cross-hairs member by the microprocessor member.

Figure 1:
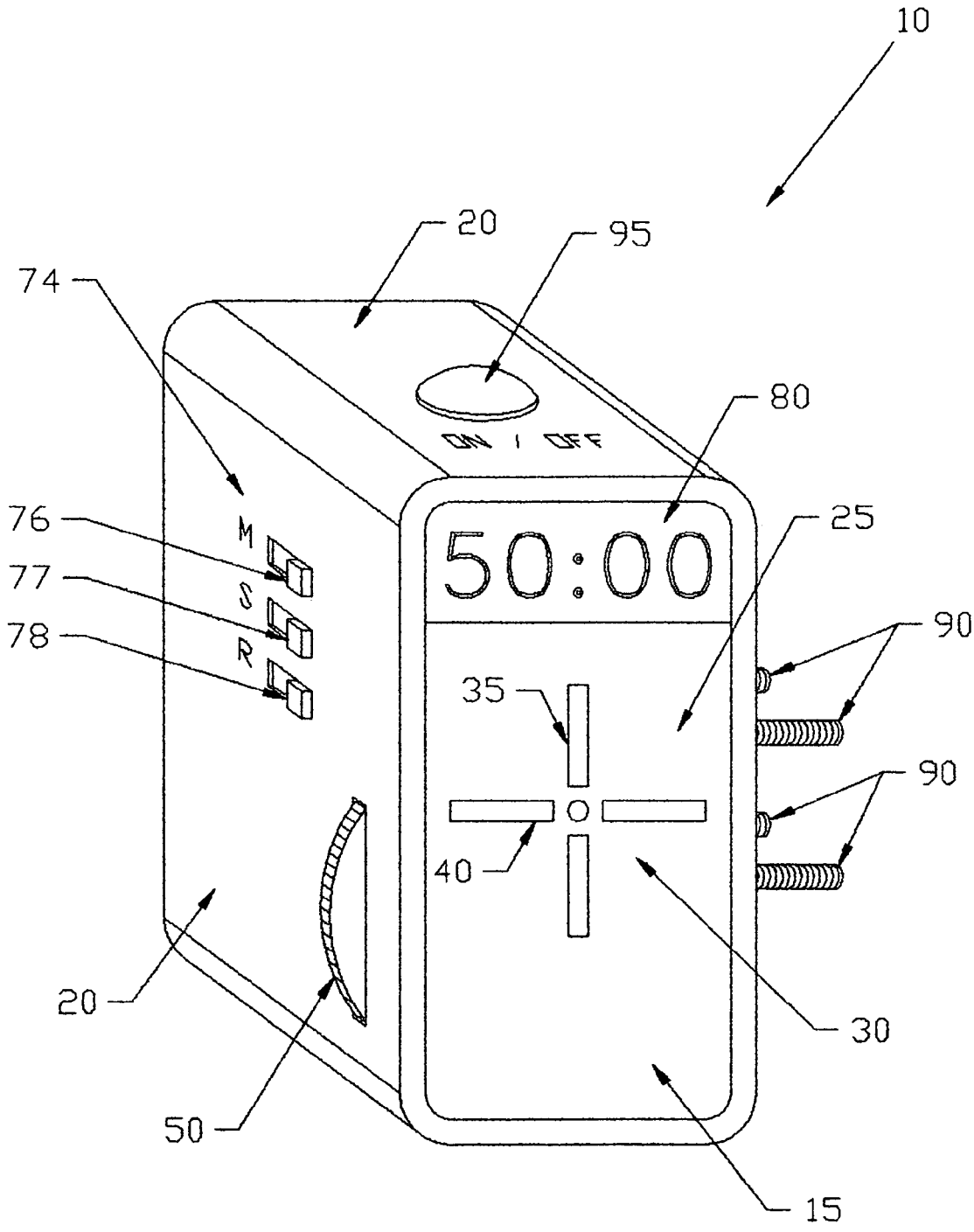
FIG. 1 is a perspective view of one embodiment of the bow-mounted sight unit containing a range finder and data storage of the present invention.
Figure 2:
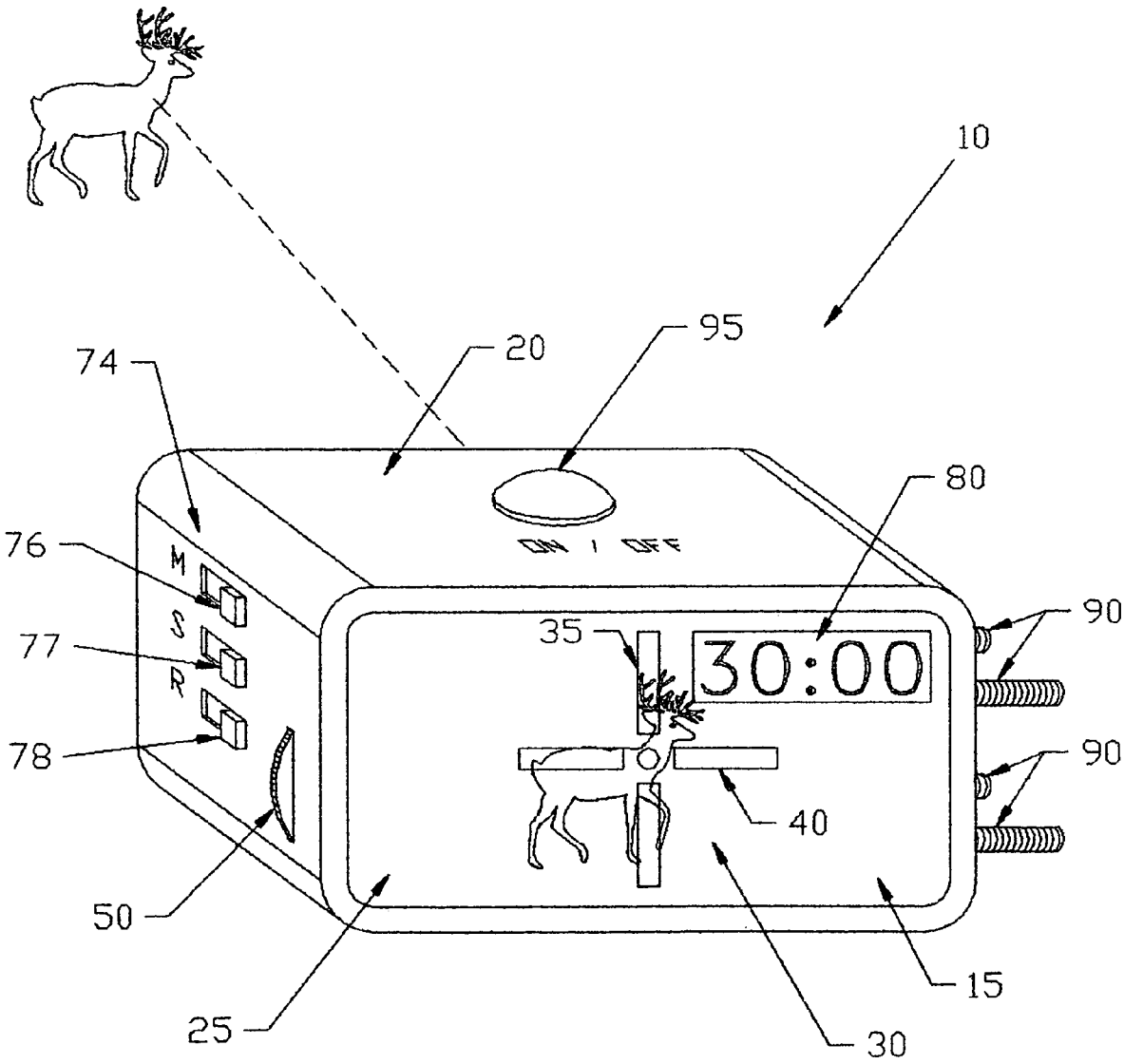
FIG. 2 is a perspective view of another embodiment of the bow-mounted sight unit containing a range finder and data storage of the present invention.

Referring now to the Figures, the bow-mounted sight unit 10, containing a range finder with data storage, or memory, is illustrated. The bow-mounted sight unit 10 includes an optical sight unit 15 for viewing a target area. The sight unit 10 has a housing member 20, which supports a viewing screen member 25 and at least one optical lens member 27 that comprises a field of view when viewed on the viewing screen member 25. A cross-hairs member 30 has a vertical sighting cross-hair portion 35, perpendicular to a horizontal sighting cross-hair portion 40, for identifying an intended target. The cross-hairs member 30 spans the interior of the sighting unit 10 and is superimposed on the viewing screen member 25, as illustrated in FIGS. 1 and 2. There is a vertical, cross-hair portion, adjustment member 50 that allows for fine-tuning the positioning of the vertical sighting cross-hair portion 40. Preferably, the adjustment member 50 is a thumb wheel protruding from an exterior surface of the housing member 20, as illustrated in FIGS. 1 and 2. A laser range finder member 60 is mounted in the housing member 20 and projects a laser beam toward the intended target.

The range finder member 60 is set to detect the target distance by aiming a laser light beam in a direction, such that it coincides with the target positioned at the intersection of the vertical sighting cross-hair portion 35 and the horizontal sighting cross-hair portion 40 of the sight unit 10. In the preferred embodiment, the laser range finder member 60 pulses repeatedly toward the target. As each pulse is initiated, a precision timing cycle is initiated, simultaneously, therewith. Knowing that the speed of light is essentially constant, the range between the bow sight unit 10 and the target is calculated easily and accurately as a function of the time it takes for a pulse to reflect off the target back to the sight unit 10, simply by multiplying the calculated time by the known speed of light. Thus, the range is constantly and repeatedly calculated and updated and shown in a display member 80 adjacent the viewing screen member 25, as illustrated in FIGS. 1 and 2.

The sight unit 15 also includes a microprocessor member 65, mounted within the housing member 20 with a data storage member 70, operatively connected to the microprocessor member 65. A control member 74 is present for manually entering and accessing data retained by the microprocessor member 65 and the operatively connected, data storage member 70. The control member 74 includes a memory button member 76, a set button member 77, and a run button member 78, all mounted on an exterior surface of the housing member 15, as illustrated in FIGS. 1 and 2. The display member 80 displays the data, that is, the range distance to the target. The display member 80 is included within the viewing screen member 25 and is visible in an area adjacent to the field of view shown on the screen member 25.

Figure 3:
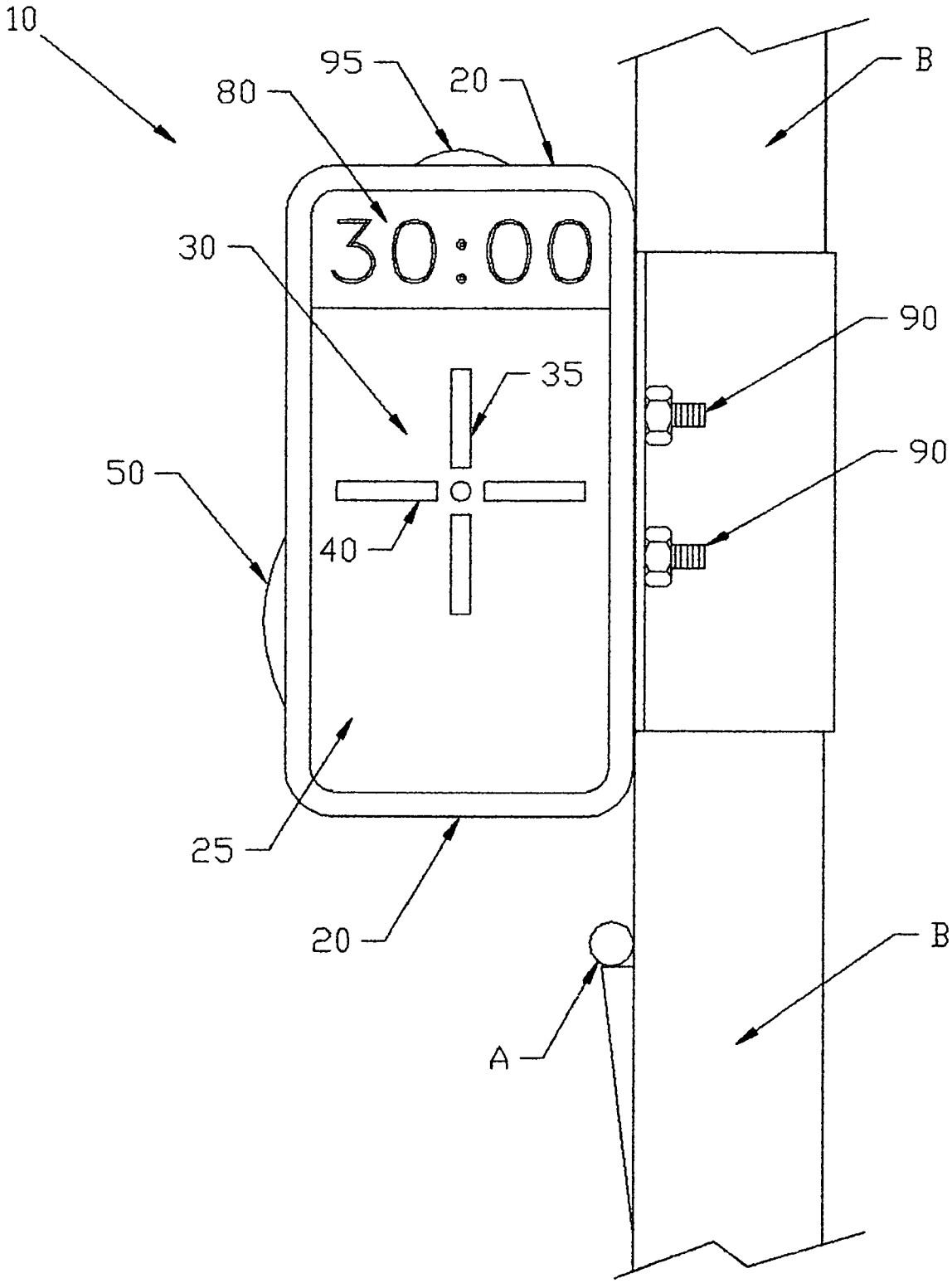
FIG. 3 is a perspective view of one embodiment of the bow-mounted sight unit containing a range finder and data storage of the present invention mounted on a hunting bow.
Figure 4:
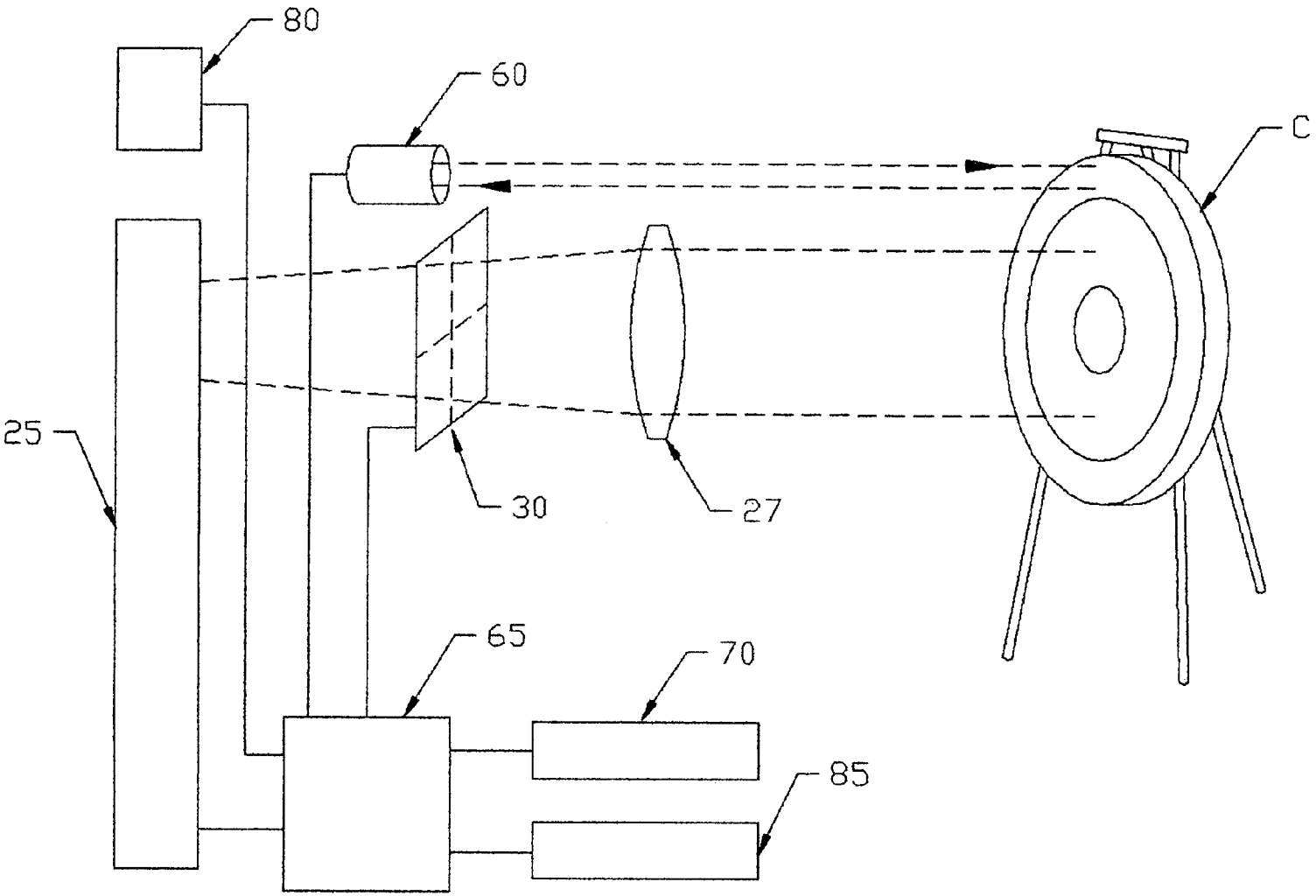
FIG. 4 is a schematic block diagram of a portion of the internal components of the bow-mounted sight unit containing a range finder and data storage of the present invention.

The housing member 15 also includes an attachment device 90 fastened to the housing member 15. The attachment device 90, such as a bracket member 90, is adapted for mounting the sight unit 10 to an archery bow B, as illustrated in FIG. 3. The bow-mounted sight unit 10 also includes a battery member 85 for powering the electronic components, including the range finder member 60, the microprocessor member 65, the data storage member 70, and the viewing screen member 25. FIG. 4 provides a schematic block diagram of a portion of the internal components of the bow-mounted sight unit 10. Preferably, the viewing screen member 25 is an LCD display, which shows the intended target and cross hairs member 30. Also included is an ON/OFF switch member 95 for activating or deactivating the bow-mounted sight unit 10. Turning off the bow-mounted sight unit 10 when not in use conserves the power of the battery member 85.

In operation, the microprocessor member 65 calculates an arrow drop compensation distance automatically, using the historical arrow-drop data in conjunction with the range distance. The compensation distance is displayed on the viewing screen member 25 by automatic adjustment of the cross-hairs member 30 by the microprocessor member 65.

In order to obtain the historical data for arrow-drop compensation for the particular arrows A used with the bow B, the hunter must "sight in" the bow and arrow at various distances using the sight unit 10 mounted thereto. The sight unit 10 includes an attachment bracket member 90 for attachment of the sight unit 10 to the bow B, as shown in FIGS. 1-3. The process begins by firing at a target at, for example, 10 yards. The hunter pushes the memory button 76 to begin the "sighting in" process. When viewed through the sight unit 10, the target range display member 80 reads "10." The hunter fires a series of arrows A, each time adjusting the cross-hairs member 30 to bring the following arrow A to dead center of the target. Adjustment is achieved by appropriate operation of the vertical cross-hair adjustment member 50. Once the sight unit 10 is sighted in at 10 yards, the hunter pushes the set button member 77 and the run button member 78 to enter the data into the data storage member 70. The hunter then moves to another distance, for example, 15 yards, and repeats the process. The target range display 80 now reads "15." Again, the hunter pushes the set button member 77 and the run button member 78 to enter the data into the data storage member 70. The process continues at 20 yards, 25 yards, etc., until the desired range distances are entered into data storage member 70.

In a preferred embodiment of the invention, the viewing screen 25 is an LCD screen. In addition, a power source, such as a battery member 85, is contained within the housing 15 for supplying electrical power to the electrical components of the bow-mounted sight unit 10 with a range finder.

While the invention has been particularly shown and described with reference to preferred embodiments thereof, it will be understood by those skilled in the art that various changes in form and details may be made therein without departing from the spirit and scope of the invention.

I claim:

1. A bow-mounted sight unit containing a range finder, with data storage, the sight unit comprising:

an optical sight unit for viewing a target area, the sight unit having a housing member supporting a viewing screen member and at least one optical lens member that comprises a field of view when viewed on the screen member;

a cross-hairs member having a vertical sighting cross-hair portion perpendicular to a horizontal sighting cross-hair portion for identifying an intended target, the cross-hairs member spanning the interior of the sight unit and superimposed on the viewing screen member;

a vertical cross-hair portion adjustment member to allow for fine-tuning the positioning of the vertical sighting cross-hair portion;

a laser range finder member mounted in the housing member, the range finder member calculating the range distance between the optical sight unit and an intended target;

a microprocessor member mounted in the housing member;

a data storage member operatively connected to the microprocessor member;

a control member for manually entering and accessing data retained by the microprocessor member and the operatively connected data storage member;

a display member for displaying the data, the display member included within the viewing screen member and visible in an area adjacent to the field of view; and a power source mounted within the housing member for energizing the viewing screen member, the range finder member, the microprocessor member and the data storage member;

wherein the microprocessor member calculates an arrow drop compensation distance automatically using historical arrow-drop data in conjunction with the range distance, the compensation distance displayed in the field of view by automatic adjustment of the cross-hairs member by the microprocessor member.

2. The bow-mounted sight unit containing a range finder, with data storage of claim 1, wherein the viewing screen is an LCD screen.

3. The bow-mounted sight unit containing a range finder, with data storage of claim 1, further including an attachment device fastened to the housing member and adapted for mounting the housing member to an archery bow.

4. The bow-mounted sight unit containing a range finder, with data storage of claim 1, wherein the power source is a battery member.

5. The bow-mounted sight unit containing a range finder, with data storage of claim 1, wherein the vertical cross-hair portion adjustment member for fine-tuning the positioning of the vertical sighting cross-hair portion comprises a thumb wheel mounted on the housing.

6. The bow-mounted sight unit containing a range finder, with data storage of claim 1, wherein the control member for manually entering and accessing data includes a memory button member, a set button member and a run button member, each mounted on the housing member.

7. The bow-mounted sight unit containing a range finder, with data storage of claim 1, further including an ON/OFF switch member for activating or deactivating the bow-mounted sight unit.

8. A bow-mounted sight unit containing a range finder, with data storage, the sight unit comprising:

an optical sight unit for viewing a target area, the sight unit having a housing member supporting a viewing screen member and at least one optical lens member that comprises a field of view when viewed on the screen member;

a cross-hairs member having a vertical sighting cross-hair portion perpendicular to a horizontal sighting cross-hair portion for identifying an intended target, the cross-hairs member spanning the interior of the sight unit and superimposed on the viewing screen member;

a vertical cross-hair portion adjustment member to allow for fine-tuning the positioning of the vertical sighting cross-hair portion;

a laser range finder member mounted in the housing member, the range finder member calculating the range distance between the optical sight unit and an intended target;

a microprocessor member mounted in the housing member;

a data storage member operatively connected to the microprocessor member;

a control member for manually entering and accessing data retained by the microprocessor member and the operatively connected data storage member;

a display member for displaying the data, the display member included within the viewing screen member and visible in an area adjacent to the field of view;

a power source mounted within the housing member for energizing the viewing screen member, the range finder member, the microprocessor member and the data storage member; and an attachment bracket fastened to the housing member and adapted for mounting the housing member to an archery bow;

wherein the microprocessor member calculates an arrow drop compensation distance automatically using historical arrow-drop data in conjunction with the range distance, the compensation distance displayed in the field of view by automatic adjustment of the cross-hairs member by the microprocessor member.

9. The bow-mounted sight unit containing a range finder, with data storage of claim 8, wherein the viewing screen is an LCD screen.

10. The bow-mounted sight unit containing a range finder, with data storage of claim 8, wherein the power source is a battery member.

11. The bow-mounted sight unit containing a range finder, with data storage of claim 8, wherein the vertical cross-hair portion adjustment member for fine-tuning the positioning of the vertical sighting cross-hair portion comprises a thumb wheel mounted on the housing.

12. The bow-mounted sight unit containing a range finder, with data storage of claim 8, wherein the control member for manually entering and accessing data includes a memory button member, a set button member and a run button member, each mounted on the housing member.

13. The bow-mounted sight unit containing a range finder, with data storage of claim 8, further including an ON/OFF switch member for activating or deactivating the bow-mounted sight unit.

14. A bow-mounted sight unit containing a range finder, with data storage, the sight unit comprising:

an optical sight unit for viewing a target area, the sight unit having a housing member supporting a viewing screen member and at least one optical lens member that comprises a field of view when viewed on the screen member;

a cross-hairs member having a vertical sighting cross-hair portion perpendicular to a horizontal sighting cross-hair portion for identifying an intended target, the cross-hairs member spanning the interior of the sight unit and superimposed on the viewing screen member;

a vertical cross-hair portion adjustment member to allow for fine-tuning the positioning of the vertical sighting cross-hair portion;

a laser range finder member mounted in the housing member, the range finder member calculating the range distance between the optical sight unit and an intended target;

a microprocessor member mounted in the housing member;

a data storage member operatively connected to the microprocessor member;

a control member for manually entering and accessing data retained by the microprocessor member and the operatively connected data storage member;

a display member for displaying the data, the display member included within the viewing screen member and visible in an area adjacent to the field of view;

a power source mounted within the housing member for energizing the viewing screen member, the range finder member, the microprocessor member and the data storage member;

an ON/OFF switch member for activating or deactivating the bow-mounted sight unit; and an attachment bracket fastened to the housing member and adapted for mounting the housing member to an archery bow;

wherein the microprocessor member calculates an arrow drop compensation distance automatically using historical arrow-drop data in conjunction with the range distance, the compensation distance displayed in the field of view by automatic adjustment of the cross-hairs member by the microprocessor member.

15. The bow-mounted sight unit containing a range finder, with data storage of claim 14, wherein the viewing screen is an LCD screen.

16. The bow-mounted sight unit containing a range finder, with data storage of claim 14, wherein the power source is a battery member.

17. The bow-mounted sight unit containing a range finder, with data storage of claim 14, wherein the vertical cross-hair portion adjustment member for fine-tuning the positioning of the vertical sighting cross-hair portion comprises a thumb wheel mounted on the housing.

18. The bow-mounted sight unit containing a range finder, with data storage of claim 14, wherein the control member for manually entering and accessing data includes a memory button member, a set button member and a run button member, each mounted on the housing member.

* * * * *